United States Patent [19]

Puariea

[11] 4,240,355

[45] Dec. 23, 1980

[54] SIDE DUMPING RAILROAD CAR

[75] Inventor: Douglas A. Puariea, St. Paul, Minn.

[73] Assignee: The Maxson Corporation, St. Paul, Minn.

[21] Appl. No.: 40,484

[22] Filed: May 21, 1979

[51] Int. Cl.[3] ..... B61D 9/02; B61D 9/06; B61D 9/10

[52] U.S. Cl. ..... 105/273; 105/271; 105/276

[58] Field of Search ..... 105/271, 272, 273, 274, 105/276

[56] References Cited

U.S. PATENT DOCUMENTS

| | | | |
|---|---|---|---|
| 1,972,042 | 8/1934 | Flowers | 105/273 |
| 3,238,897 | 3/1966 | Flowers | 105/273 X |

*Primary Examiner*—Howard Beltran
*Attorney, Agent, or Firm*—Neil B. Schulte

[57] ABSTRACT

A side dump rail car tilted by means of hydraulic cylinders at each end of the car which are centrally located. The edge of the car is retained by an engagement lug slid into place hydraulically to determine direction of tilt.

1 Claim, 6 Drawing Figures

FIG. 1
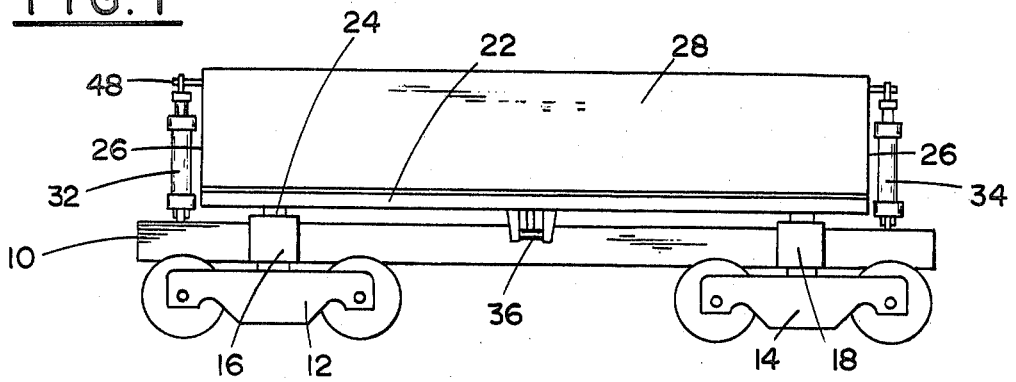
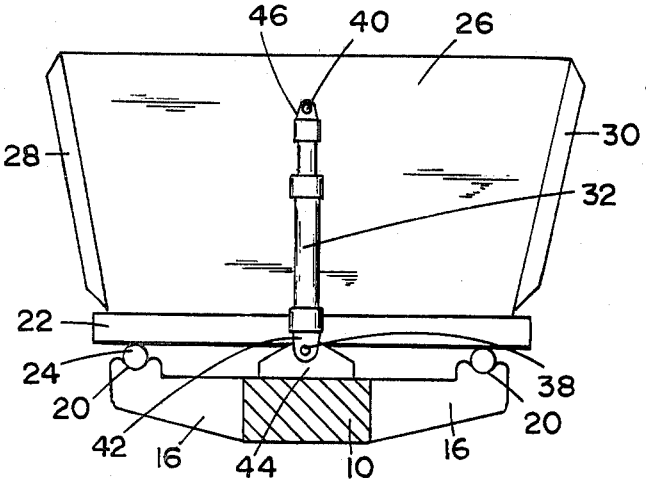
FIG. 2
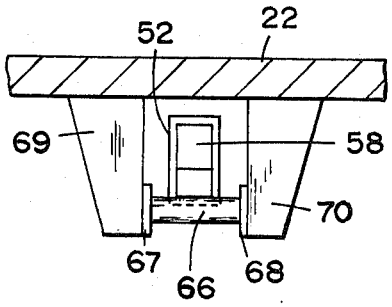
FIG. 5
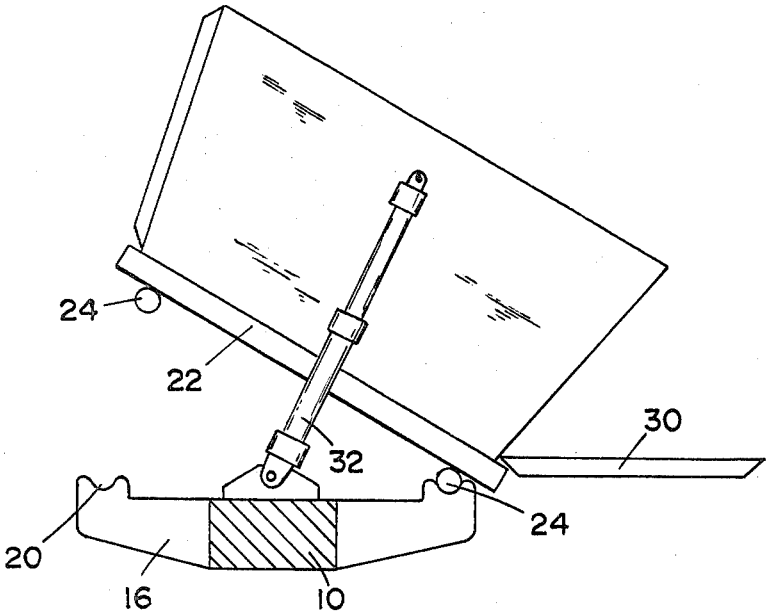
FIG. 3

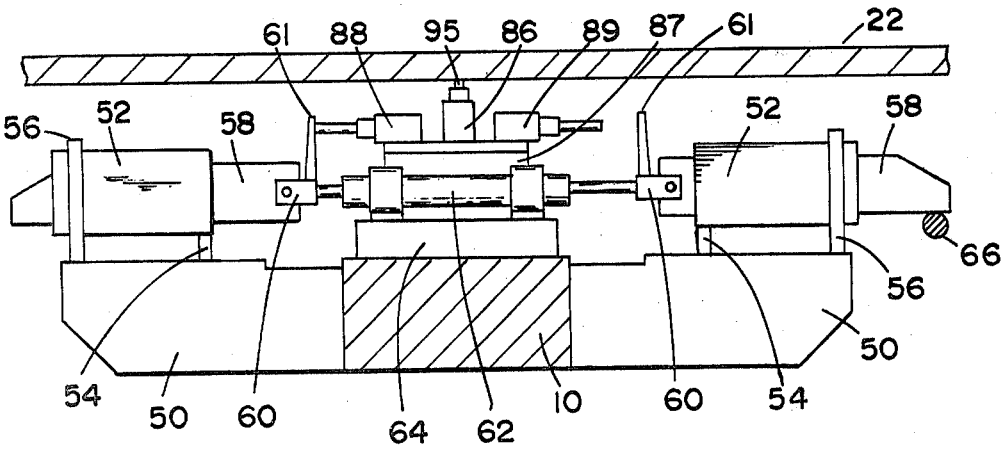
FIG. 4
FIG. 6
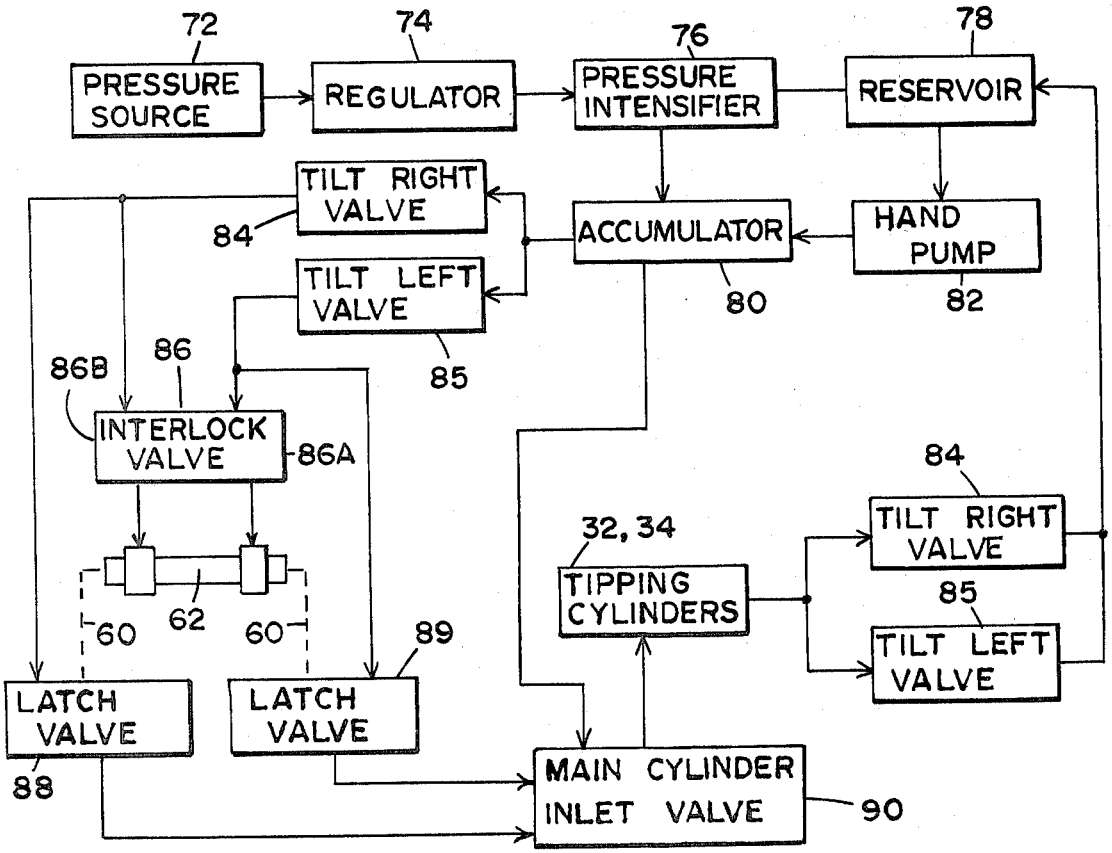

SIDE DUMPING RAILROAD CAR

BACKGROUND OF THE INVENTION

Prior art side dump railway cars typically utilize air cylinders positioned on one side of the car to lift that side causing the contents of the car to be dumped on the opposite side. Usually, two very large telescoping air cylinders are used on each side of the car for a total of four very expensive cylinders. Air cylinders are generally chosen to make use of the pressurized air supply present on trains. However, since air is compressible and quite springy the tilting action tends to be erratic and uncertain. The side dump car may stick in place momentarily until pressure builds and then move suddenly creating hazardous operation. In addition the size of the cylinders requires that they be carried quite low and outboard on the car making them highly susceptible to damage in the event of derailment. Furthermore, the large air cylinders must be custom built and are extremely expensive. A further disadvantage of air cylinders is encountered when the air continues to expand after the supply is shut off thus producing an additional and unwanted body movement. Greater tipping of the dump body shifts the center of gravity so as to relieve the pressure on the air cylinders. Consequently, the air may expand even more and tip the body even further. If this occurs near the over center point and the load is frozen or compacted or the door fails to open, it is possible to tip the car over. These problems are overcome by my invention as described hereinafter.

BRIEF SUMMARY OF THE INVENTION

Briefly, the present invention contemplates the use of hydraulic cylinders positioned one at each end of the side dump car operating at a location coincident with the center line of the car. The direction of tipping is determined by holding down a selected side of the car with an engagement lug which is also hydraulically operated. The number of dump cylinders is reduced from four to two in this design. Also the cylinders are of moderate bore size and are commercially available. Accordingly, they are very much less expensive than the prior art air cylinders. Since the hydraulic cylinders are smaller, a more compact and lighter car design is possible. With the cylinders positioned at the end of the car and above the frame they are well protected in the event of derailment of the car. Hydraulic cylinders operate with an imcompressible fluid so that a totally positive control is rendered allowing the car to be tilted to the exact angle desired without any further unwanted movement. In the event of the loss of pressure the car can also be dumped with an auxiliary hand pump which is generally not possible with air cylinders. Also, whereas the prior art air cylinders were subject to freezing due to water condensate being present in the system, my invention works equally well in all weather conditions. It may therefore be seen that it is an object of my invention to provide an improved side dump car which is much less expensive, safer, lighter, and more reliable. Further objects and advantages will become apparent from the following detailed description and drawings.

BRIEF DESCRIPTION OF THE DRAWINGS

FIG. 1 is an elevational schematic side view of a side dump railway car according to the present invention with hydraulic cylinders positioned at each end.

FIG. 2 is an elevational end view of the frame and dump body portion of the car of FIG. 1.

FIG. 3 is similar to FIG. 2 but shows the dump body in a tilted position.

FIG. 4 comprises a detail view of the hydraulic latch mechanism that holds down one side of the car to determine the direction of tilt.

FIG. 5 is a detail view showing how the engagement lug bears against a reaction pin to hold one side of the car down.

FIG. 6 is a schematic diagram showing how the hydraulic fluid is pressurized and controlled.

DESCRIPTION OF THE PREFERRED EMBODIMENT

In FIG. 1 a much simplified schematic drawing of a side dump rail car is presented. A main frame 10 is carried by suitable bolsters on a pair of wheeled trucks 12 and 14 in a manner well known to those skilled in the art. At each end of the car a pair of underframe bolsters 16 and 18 extend outward to form cradles 20 which carry the tilt bed 22. Tilt bed 22 has conventional pivot bearings 24 on the bottom side thereof which rest in cradles 20 in a manner well known to those in the art. A hopper body is formed on top of tilt bed 22 by means of a pair of end plates 26 and side doors 28 and 30.

Two hydraulic cylinders 32 and 34 are positioned at each end of the car to provide the tilting force. The direction of tilt is determined by holding a selected side of the car down with a locking mechanism 36.

FIGS. 2 and 3 more clearly show the tilting action and the cylinders 32 and 34. Each of the end positioned hydraulic cylinders 32 and 34 is positioned on the center line of the car operating between pivot points 38 and 40. Pivot point 38 is created by a suitable clevis 42 operating on a bracket 44 while pivot point 40 could comprise a clevis 46 and a pin 48. Several variations on this mechanism will be readily apparent and a further detailed description is deemed unnecessary. When the hydraulic cylinders extend, as shown in FIG. 3, the tilt bed 22 will remain in the cradles 20 on the side held down by the locking mechanism 36. The remaining pivot bearing 24 will lift up so as to tilt the car body to one side. At the same time, a suitable door operating linkage, which is not shown in this specification, will lower the appropriate door 30 as is necessary. Such door opening mechanisms are well known in the art and not further described herein.

A locking mechanism 36 which holds the desired side of the car down in the cradles 20 is described in greater detail in FIG. 4. A pair of mid-car supports 50 are fastened to main frame 10 and extend out to hold a pair of torque boxes 52. Each torque box 52 is mounted on mid-car support 50 with a compression member 54 and a tension strap 56. A pair of engagement lugs 58 are adapted to slide in torque boxes 52. Engagement lugs 58 are connected with the clevis pins 60 to a double acting hydraulic cylinder 62. Cylinder 62 is also mounted on main frame 10 with a suitable support 64. Depending upon the selected direction of tilt, oil is delivered under pressure to hydraulic cylinder 62 so as to move engagement lugs 58 either left or right. In FIG. 4 the mechanism is shown with the engagement lugs 58 positioned to the right so as to engage a reaction pin 66 and hold down the right hand side of the car. Reaction pin 66 is mounted to the underside of tilt bed 22 as shown in FIG. 5. Reaction pin 66 extends between a pair of support members 67 and 68. Support member 67 is fastened to the underside of tilt bed 22 by two or more gussets 69. In a like manner, support 68 is connected to tilt bed 22 by gussets 70. Thus, tilt bed 22, through gussets 69 and 70 and reaction pin 66, is trapped under engagement lug 58 and the chosen side of the car is held down to allow it to be tilted by only two cylinders as shown in FIG. 3.

A schematic diagram of the hydraulic system is shown in FIG. 6. The air pressure source 72 on the train is connected through a pressure regulator 74 to a pressure intensifier 76. Intensifier 76 may comprise a conventional reciprocating air to oil intensifier which will pump oil from a reservoir 78 to an accumulator pressure tank 80. Accumulator tank 80 ensures that a sufficient supply of pressurized oil will always be available to dump the car. It should be noted that hydraulic systems will maintain their pressure indefinitely so that the car can be tilted even after it has been separated from the train for a considerable period of time. This is in contrast to the prior art air operated systems which usually leak to zero pressure in less than a days time. However, even in the event of loss of pressure an optional auxiliary hand pump 82 may be utilized to pressurize the accumulator 80.

The car is dumped by selecting either a tilt right valve 84 or a tilt left valve 85 positioned on opposite sides of the car. Either valve 84 or 85 will deliver pressurized oil to appropriate sides of a double acting cylinder 62 through an interlock valve 86. Valve 86 is shown in FIG. 4 mounted on a bracket 87. Valve 86 is open only when tilt bed 22 is in the lowered or rest position and in physical contact with the plunger 95 of valve 86. When this condition is met, both halves of valve 86, shown in FIG. 6 as 86A and 86B, operate to allow oil to pass from the selected valve 84 or 85 to cylinder 62. Cylinder 62 will operate the engagement lugs in the manner described with respect to FIG. 4 to latch the selected side of the car down. Only when the car is completely latched can the lifting sequence begin. This is insured by a pair of latch valves 88 and 89 which are also mounted on bracket 87 in FIG. 4. In the right hand shifted position shown in FIG. 4 a tab 61 extending up from clevis 60 operates latch valve 88 so as to allow oil to pass from valve 84 to a main cylinder inlet valve 90. If the locking mechanism 36 were shifted in the opposite direction the other tab 61 would engage valve 89, again only after the engagement lugs 58 had fully trapped reaction pin 66. Either valve 88 or 89 will operate main cylinder inlet valve 90 to allow pressurized oil from accumulator 80 to go to the tipping cylinders 32 and 34. After the contents of the car have been emptied, the car may be lowered again by reversing tilt valves 84 and 85 so as to vent oil from the tipping cylinders 32 and 34 back to reservoir 78.

The present invention contemplates the use of hydraulic flow rate controls in the system of FIG. 6 so as to provide a constant rate of raising and lowering of the tilt bed 22. Of course, check valves would also be incorporated into the system to ensure the proper directional flow of hydraulic fluid. These detail modifications and others are clearly possible without departing from the spirit and scope of the invention and accordingly I intend to be bound only to the appended claim.

I claim:

1. A side dumping railway car comprising in combination:

a plurality of wheeled trucks;

a main car frame carried on said trucks;

transverse support bolsters on said main car frame having pivot cradle means thereon;

a hopper resting in said pivot cradle means;

hydraulic cylinder means comprising a single hydraulic cylinder at each end of the car connected to a pivot point on said main car frame at one end of the cylinder and to a pivot point on the hopper at the other end of the cylinder, said pivot points positioned generally on the centerline of the car to permit generally vertical lifting of the hopper relative to the main car frame;

hopper retaining means on each side of the car adapted to hold down one side of the hopper when said hopper is raised by said hydraulic cylinder means so as to raise the hopper on the side opposite said one side, said hopper retaining means comprising a hydraulically moved engagement lug on said main car frame adapted to slide into position to hold down a reaction pin, said reaction pin connected to one side of said hopper;

an air to oil pressure intensifier on said car adapted to pump oil from a reservoir to an oil accumulator, the pressurized oil from said accumulator connected through tilt control valves to operate the hydraulic cylinders; and an interlock valve means between said tilt control valves and a latch valve means to prevent the passage of pressurized oil to the hydraulically moved engagement lug when the hopper is raised from the main car frame, said latch valve means operated by the movement of said engagement lug into position against said reaction pin and adapted to pass pressurized oil to the lifting hydraulic cylinder means only after said engagement lug has slid into position to hold down said reaction pin.

* * * * *